United States Patent [19]

Bateman et al.

[11] Patent Number: 4,710,231

[45] Date of Patent: Dec. 1, 1987

[54] SOLID FRUCTOSE

[75] Inventors: John R. Bateman, Frilsham; Brita C. Goodacre, Sonning; Alan Smithson, Reading, all of England

[73] Assignee: Tate & Lyle Public Limited Company, England

[21] Appl. No.: 568,584

[22] Filed: Jan. 6, 1984

[30] Foreign Application Priority Data

Jan. 7, 1983 [GB] United Kingdom ..... 8300333
Nov. 7, 1983 [GB] United Kingdom ..... 8329647

[51] Int. Cl.[4] ..... F24B 3/00

[52] U.S. Cl. ..... 127/30; 127/58; 127/60

[58] Field of Search ..... 127/58, 60, 61, 30

[56] References Cited

U.S. PATENT DOCUMENTS 4,199,374 4/1980 Dwivedi et al. ..... 127/60
4,371,402 2/1983 Kubota ..... 127/60
4,517,021 5/1985 Schollmeier .

FOREIGN PATENT DOCUMENTS 1206040 9/1970 United Kingdom ..... 127/60
2133796 8/1984 United Kingdom ..... 127/60

*Primary Examiner*—R. B. Penland
*Attorney, Agent, or Firm*—Ostrolenk, Faber, Gerb & Soffen

[57] ABSTRACT

Solid fructose, typically with a bulk density of less than 0.65 g/ml and in the form of particles of agglomerated microcrystals of anhydrous fructose in which all the crystals have a maximum dimension of less than 50 microns, can be produced by dispersing a high Brix fructose syrup at very high shear in an alcoholic medium, the alcoholic medium being one in which fructose is 1 to 10 wt % soluble at the temperature at which the syrup is dispersed in the alcoholic medium.

19 Claims, 6 Drawing Figures

100μm

50μm

16μm

SOLID FRUCTOSE

At present there are three main routes to producing solid fructose; crystallisation from an aqueous liquor, crystallization from an alcoholic liquor and total syrup solidification.

Aqueous crystallisation is typified by the process described in U.S. Pat. No. 3,883,365. This process is currently employed for fructose manufacture on an industrial scale, and involves seeding a concentrated fructose solution at a pH of 4.5 to 5.5. Crystals of size 200 to 500 microns are obtained. The process is very slow, with a typical crystallization taking 50 hours or more to give a yield of 50%.

Alcoholic crystallisation is typified by the Boehringer method of U.K. Pat. No. 1,206,040. In this method, a methanolic solution of fructose at a preferred methanol:fructose ratio of 1:1 is seeded in a multi-chamber crystallization vessel to give a slurry containing crystals with a particle size of 60 microns or more, most of the crystals being 100 to 400 microns. Compared to the aqueous crystallization, the methanolic crystallization is more efficient, taking 10 to 15 hours and giving a yield of over 80%.

Solidification processes are typified by the procedure of U.K. Pat. No. 1,117,903, in which fructose syrup is concentrated, seeded, stirred to a kneadable mass, and allowed slowly to solidify. The product is a solid mixture of crystals and glass, but there is the advantage that the procedure only takes around 1 to 2 hours.

More generally, fructose is exceptionally difficult to crystallize and is usually sold as a fructose syrup. There remains a need to develop an efficient, fast way of forming solid fructose from such syrups.

In accordance with the present invention, there is provided a process for producing solid fructose, wherein a high Brix (i.e., a high wt%) fructose syrup is dispersed at very high shear in an alcoholic medium to give solid fructose, the alcoholic medium being one in which fructose is soluble to the extent of 1 to 10 wt% at the mixing temperature at which the syrup is dispersed in the alcoholic medium.

It is an essential feature of the present invention that the high Brix fructose syrup is dispersed at very high shear in the alcoholic medium: the present process does not work if the alcohol is dispersed in the syrup.

Without being bound by any theory, we believe that the act of dispersing the syrup at very high shear in the alcoholic medium results in nucleation of fructose and crystallization, and that such nucleation is not achieved when the alcohol is instead added to the syrup.

U.S. Pat. No. 2,357,838 describes a process for the production of a sugar where alcohol is added to a syrup. The known process comprises preparing an invert sugar solution having a sugar content of at least 92 Brix, adding ethyl alcohol having a concentration of at least 90% thereto, subjecting to the influence of vigorous mechanical stirring throughout at a rate of at least 200 RPM, thereby inducing rapid crystallization of dextrose, allowing dextrose to crystallize, separating crystallized dextrose from mother liquor, concentrating said mother liquor, and then in like manner adding ethyl alcohol, stirring vigorously, and permitting levulose to crystallize.

U.S. Pat. No. 4,371,402 describes a multi-stage process for preparation of solid fructose, involving dehydrating a fructose syrup to less than 3% water using an organic solvent and evaporation, aging the dehydrated syrup with seed crystals in 1 to 20% organic solvent to give a deliquescent crystalline aggregate, solidifying the aged material by introducing it in to an alcohol, and removing the alcohol from the resultant solid. The aging alone typically takes from 1 to 10 hours, whereas the present process can be much quicker.

The present process is capable of yielding various forms of solid fructose, depending mainly on the ratio of syrup to alcoholic medium. In particular, when the ratio is relatively low, the process can be used to precipitate microcrystals of fructose, while when the ratio is relatively high, the process can be used to solidify the syrup completely. Other forms of fructose such as granules, powder, or pellets can also be produced by further processing.

The present invention employs a high Brix fructose syrup which is dispersed at very high shear in to an alcoholic medium. The syrup is supersaturated at the dispersion temperature. For preference, the syrup is at least 88 Brix, more preferably at least 93 Brix and most preferably from 95 to 98 Brix, though syrups of higher or lower Brix can be used. The high Brix syrup can be prepared from an available syrup of lower Brix, using for example a commercially available fructose syrup.

In general some pre-treatment of the available low Brix syrups may be necessary, particularly in order to remove impurities might precipitate when dispersion in the alcoholic medium is effected. Examples of suitable pre-treatments include enzymic hydrolysis, carbon decolourization, and other methods of reducing the amount of alcohol-insoluble oligosaccharides which might precipitate fructose crystallization.

Thus, for a commercial fructose syrup derived from starch hydrolysates, treatment with amyloglucosidase and/or with activated carbon can give a fructose syrup which does not give a haze on addition of alcohol, and which can readily be converted to a solid form. The enzyme can be used in a liquid form in a batch system, or in an immobilised form leading to much reduced contact time. For example, fructose syrup at 15 to 50 Brix can be treated in batch with amyloglucosidase at 0.005 to 0.5% v/v enzyme solution/syrup at 35° to 65° C. for 5 to 30 hours, or it can treated with immobilized amyloglucosidase in a continuous system running at 2 to 10 empty column volumes/hour at similar temperatures.

The temperature of the high Brix syrup is normally above room temperature and below 85° C. in order that the syrup is sufficiently mobile and in order that the temperature of the resultant dispersion remains sufficiently low. The syrup temperature also has to be selected having regard to the need for supersaturation at the dispersion temperature. The syrup temperature will vary with the syrup Brix, but is preferably between 10° and 90° C., typically from 75° to 85° C. for a 95 Brix syrup, from 55° to 60° C. for a 90 Brix syrup, from 15° to 20° C. for a 80 Brix syrup, and correspondingly at other temperatures for other syrups. In practice, this requirement means that usually the syrup will have to be cooled or allowed to cool following a concentration step.

For preference, the solids in the syrup comprise at least 90% fructose, usually around 95% fructose. It is also preferred that the syrup contains less than 10% glucose, more preferably less than 5% glucose. Indeed, the present invention does not work with invert sugar or similar mixtures of fructose and glucose.

In the present invention, the very high shear is suitably in the range 2,000 to 200,000 $s^{-1}$, with a shear of 20,000 to 100,000 $s^{-1}$ being convenient. For a batch process, the very high shear is preferably applied in bursts of up to 20 seconds, typically about 5 seconds, as the syrup is dispersed into the alcohol. For a continuous process, the residence time of the stream under conditions of very high shear will depend on the flow rate and degree of recycling, among other factors.

The alcoholic medium in which the dispersion is generated is an alcoholic one in which fructose is soluble at about 1 to 10 wt%, more preferably 2 to 6 wt% and most preferably 3 to 5 wt%, at the dispersion temperature being the temperature of the mixture of syrup and alcoholic medium immediately after the syrup is dispersed in the alcoholic medium. The medium should be miscible with water, non-toxic and have a viscosity of about 10 cps. As an aid to processing, the medium should also have a low boiling point (below 100° C.) to facilitate removal of the medium from the product.

One or more alcohols such as methanol, ethanol and isopropanol can be used to form the alcoholic medium with desired ability for dissolving fructose. For the typical dispersion temperature of 40° to 45° C., suitable media include ethanol (fructose solubility 3.5% at 42° C.) and a 50:50 mixture of methanol with isopropanol (fructose solubility 4.8% at 42° C.). The medium can contain some water, though this will modify the solubility characteristics. The alcoholic medium preferably contains less than 4% water, and most preferably less than 2% water.

In general, the solubility of fructose in an alcohol decreases with increase in the number of carbon atoms in the alcohol. Thus the dissolution power of any given medium can be raised by increasing the proportion of lower alcohol and correspondingly it can be lowered by increasing the proportion of higher alcohol. In practice, ethanol itself has suitable solubility characteristics at most temperatures and is greatly preferred. The use of azeotropic ethyl alcohol containing around 5% water is convenient: the medium can be industrial methylated spirits. For the best results, the ethanol preferably contains less than 4% and most preferably less than 2% water.

The alcoholic medium is preferably employed in an amount of up to 3 ml/g, in terms of solvent volume per syrup weight, and more preferably 0.1 to 2 ml/g, usually 0.2 or 0.3 to 1.5 ml/g.

For the preparation of particles as a filterable slurry, the lower limit is typically around 0.5 ml/g. Thus, in one aspect, the process of the invention involves precipitating fructose by applying very high shear at a solvent:syrup ratio of 0.5 ml/g or more. The precipitate comprises particles made up of very fine, loosely agglomerated, white microcrystals, and after drying is usually a free flowing powder. The particles possess some distinctive characteristics, and also form part of this invention.

Hence, in accordance with this invention, there is provided a novel physical form of fructose comprising particles of loosely agglomerated, integral microcrystals of anhydrous fructose in which all the crystals have a maximum dimension of less than 50 microns. The particles themselves will typically have a maximum dimension of 75 to 300 microns, but his value depends greatly on the processing conditions and smaller or larger agglomerates are readily formed ranging up to 1 mm or more in size. In the typical particulate product from a relatively pure syrup, at least 95% of the crystals will be generally rod-shaped with a length of 10 to 30 microns and a width of 2 to 10 microns. The length:-width aspect ratio will usually then be from 2:1 to 8:1. When using impure syrup, the shape of the crystals will usually be less discernable owing to the higher proportion of glassy material.

For the complete solidification, a solvent/syrup ratio down to about 0.1 ml/g is appropriate. This lower ratio can be achieved gradually or stepwise, for example by adding further syrup to a slurry of the particles produced using a solvent/syrup ratio of 0.5 ml/g or above. The product at the lower ratios typically sets to a hard block which may be comminuted and dried to provide granules or powder. Thus, in another aspect, the process of the invention involves solidifying fructose by applying very high shear while dispersing the syrup in to the alcoholic medium, down to a final solvent:syrup ratio of below 0.5 ml/g. In a batch process, the syrup is preferably added in two or more portions with a gap between them of usually 5 to 20 minutes: very high shear mixing is used at least during the addition of the initial portion, and usually as each portion is added. The solidifying mass can be shaped into a desired form. Total solidification has the advantage that no recycle of mother liquor is required and that the yield is effectively 100%.

The totally solidified product also possess some distinctive characteristics, and when comminuted forms part of this invention.

Hence, in accordance with this invention, there is provided a novel physical form of fructose comprising a comminuted mass of agglomerated crystals of anhydrous fructose in which 95% of the crystals have a maximum dimension of less than 20 microns, there usually being some particles which are larger and apparently formed by fusion of two or more crystals. The particles will usually be irregular in shape.

The products of this invention, whether prepared by precipitation or by total solidification and comminution, have a typical bulk density of less than 0.65 g/ml, more usually between 0.5 and 0.55 g/ml, and are readily soluble in water. The optical rotation of a freshly prepared aqueous solution of the product made from pure fructose syrup will usually approach −133°, corresponding to the beta-D-pyranose form of fructose. The heat of melting will typically be about 140 J/g for product made from pure frustose syrup. In general, there will be at least 50% crystallinity, normally more than 70% crystallinity.

In order to aid dispersion of the syrup in the alcoholic medium, the medium can be at above room temperature. A temperature of 20° to 40° C. for the medium is normally appropriate. The medium must not be at too high a temperature, bearing in mind the general need to prevent the dispersion temperature from rising above 60° C. Usually the dispersion temperature at which the syrup is dispersed in the alcoholic medium has to be between 20° and 55° C., typically 40° to 45° C. or 50° C. In general, the temperature has to be one at which the syrup is supersaturated. Low dispersion temperatures are appropriate when using relatively low Brix syrups, and correspondingly, high temperatures for high Brix syrups. Some cooling of the medium during dispersion of the syrup may be necessary to dissipitate heat generated by the very high shear.

Where the syrup is dispersed in the medium to precipitate the particles of fructose, a white slurry is obtained.

The particles can then be separated off from the medium, for example by filtration, optionally after holding the slurry quiescent or under gentle agitation to allow equilibration and cooling. If desired, the alcoholic medium can be recycled after separation from the particles and removal of excess water.

Where the syrup is dispersed in the medium to give a solidifying mass of fructose, a white solid is obtained which gradually hardens and usually sets within a short period of time. The solid, which is normally about 80% crystalline, can then be broken up to give a particulate product which can be dried to give a free-flowing material. The particles obtained by either route can be dried, for example by heating as a static bed or heating with agitation such as by tumbling or in a fluid bed, or by use of a vacuum. Thereafter, if the particles are not being used immediately, they should be kept at less than 60% relative humidity in view of their hygroscopic nature.

The products of this invention can be used in their existing physical form, or the physical form can be modified. For example, the particles can be agglomerated or pelletized.

The present products can be used as a sweetening agent in the same way as conventional solid fructose products. For example, they can be used in baked products, desserts, beverages, jams, chocolate, low-calorie products, confectionery, diabetic products, brewing, fruit storage, cream icings, and yoghurts.

In addition, the products of this invention can be used in applications for which conventional solid fructose products are not particularly well suited. For example, the products of this invention show promise as tabletting materials without the use of a binder such as gum arabic. Exceptionally, the present products can give coherent tablets by direct compression with a lubricant. Special pre-treatments such as moist granulation are not needed.

Thus, the present invention further provides tablets based on a solid diluent which comprises a fructose product of this invention. The tablets can take any of the usual shapes, and suitably contain an active ingredient and one or more additives employed for example to colour the tables, aid binding, give effervescence, or aid release from a tabletting machine.

Furthermore, the present products can be used as carriers for oils, fats and oil-based flavours. Spraying or other procedures can be used to impregnate the fructose with the oil, fat or flavour.

Another new use for the present solid fructose is as a quick-dissolving sweetener. For example, the fructose can be used in dry pre-mixes for fruit beverages.

Apart from the uses as a sweetener, the present products can also be used as seed crystals for seeding fructose syrups.

Usually, fructose syrup is seeded in the known crystallization procedures by the use of fragmented fructose crystals obtained by grinding, but the integral particles of this invention may be used directly as a seed by virtue of their inherent small size, thereby avoiding the need for grinding. Thus, the particles of this invention or, less preferably, some other seed can be added to a fructose syrup for use in a process of the present invention. Crystals capable of acting as seed will be present in the reaction vessel when the present process is operated on a continuous basis with recycling.

In summary, a particularly preferred process of this invention for producing solid fructose generally involves a solvent to syrup ratio of 0.2 to 1.5, with less than 5% moisture in the solvent, a syrup of 94 to 98 Brix with solids of about 95% fructose, and precipitation or total solidification at 40° C. or 45° C. usually followed by cooling over 10 to 20 minutes to ambient temperature. Treatment with amyloglucosidase and/or activated carbon is preferred when using a commercially available fructose syrup derived from hydrolysed starch. Evaporation of most commercially available fructose syrups will also be needed since they are usually less than 80 Brix.

The present invention will now be described in more detail by way of Examples:

In these Examples, reference is made to the accompanying drawings, in which.

Figure 4:
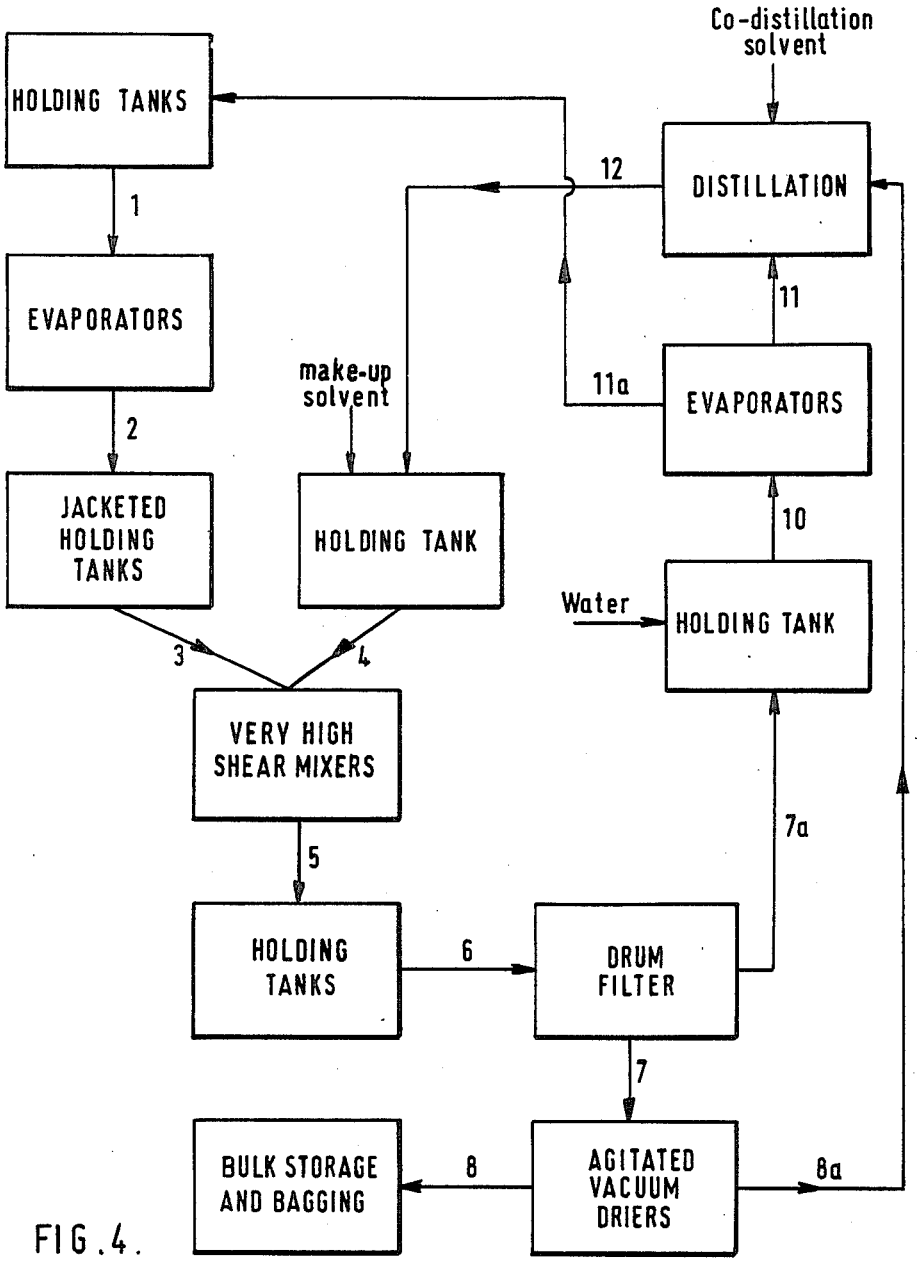
Figure 5:
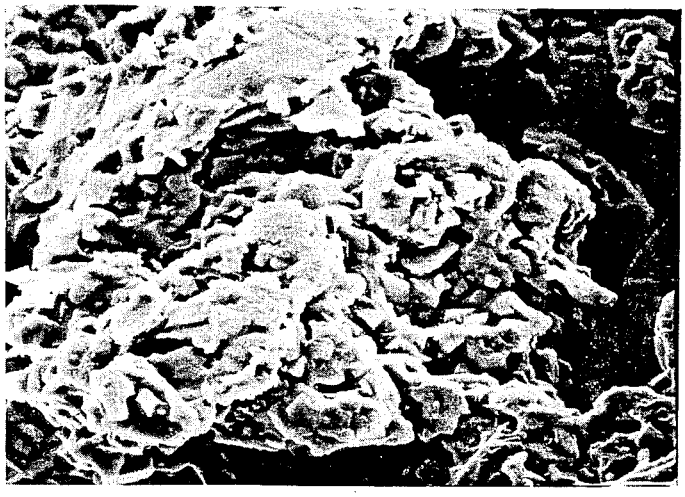
Figure 6:
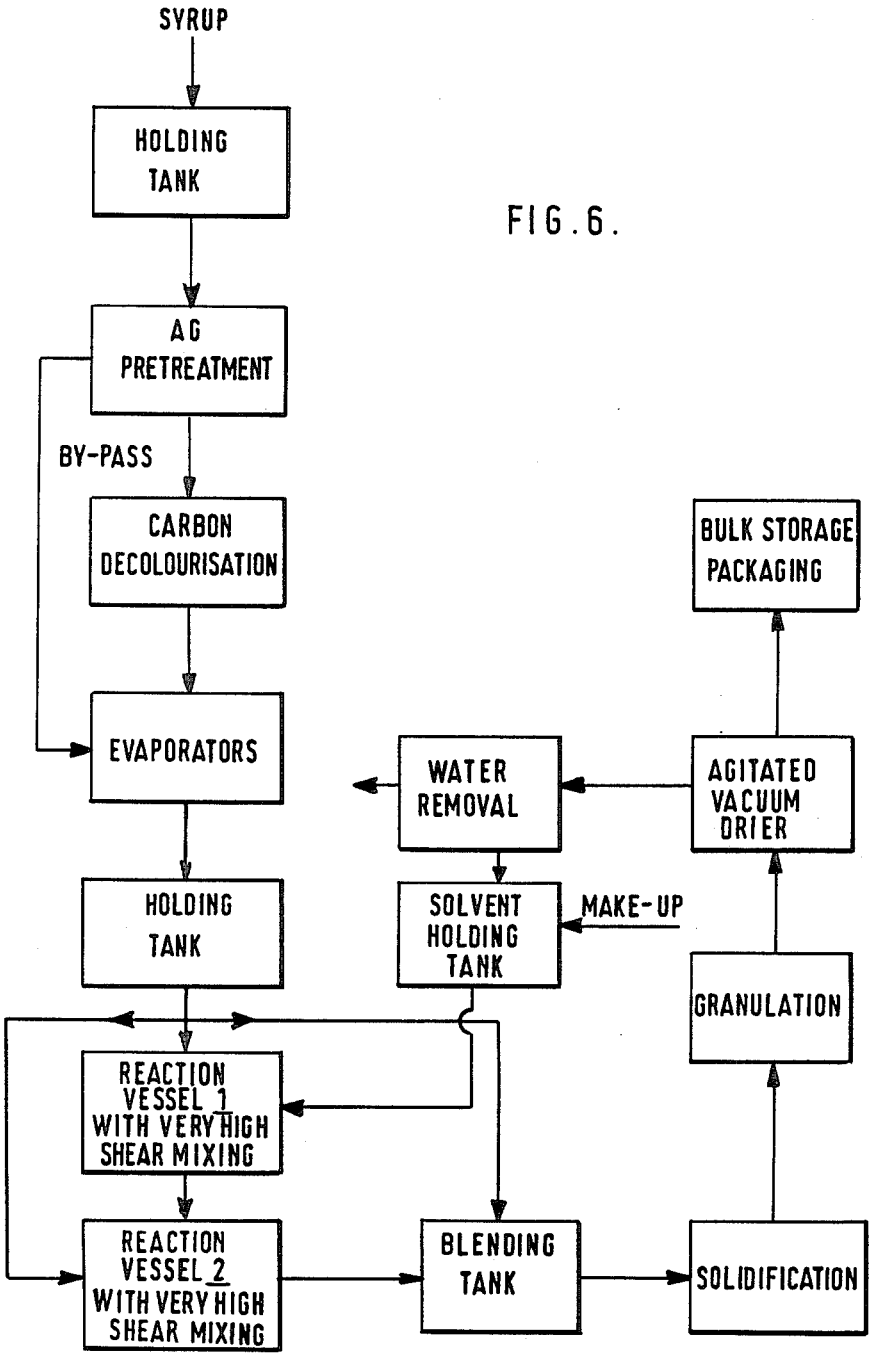

FIG. 4 is a block diagram of equipment for carrying out a continuous precipitation process in accordance with the invention on an industrial scale, FIG. 5 is a micrograph at about 800 magnification of a typical product of this invention produced by the procedure of Example 26, and FIG. 6 is a block diagram of equipment for carrying out a continuous solidification process in accordance with the invention on an industrial scale.

EXAMPLES 1 TO 8

The apparatus consisted of a bench size Silverson very high shear mixer and a 250 or 400 ml glass beaker. The syrup was pure fructose syrup in all Examples except for Example 4 (91.75% fructose and 8.25% glucose) The syrup was prepared from "Fructofin" fructose (greater than 99% fructose) and deionised water: glucose for Example 4 was "Fisons" AR grade (above 99% pure). Typically the amount of syrup used in any run was between 100 and 150 g, depending on the solvent to syrup ratio. Allowance was made for syrup retaind in the preparation beaker.

The industrial methylated spirits ("IMS") contained about 1 or 2% methanol and about 1 or 2% water, or about 4% for the azeotrope used in Example 7. The ethanol was of laboratory grade. The volume of solvent was sufficient just to cover the mixer head, between 80 and 200 ml.

In each Example, syrup was carefully added to the alcoholic medium whilst shearing it with the mixer. Cooling when required was provided by placing the mixing beaker in a dish of water or ice. The mixtures were agitated for a short period, typically approximately 20 seconds. The resulting mixture was then slowly stirred for several minutes whilst its temperature approached ambient. The resulting slurry was filtered and the solid dried overnight in a vacuum oven at 50° C.

The conditions are shown in Table 1.

TABLE 1

| Example number | syrup Brix | syrup temp | solvent | solvent:syrup ratio (ml/g) |
|---|---|---|---|---|
| 1 | 95 | 83 | IMS | 1.0 |
| 2 | 95 | 83 | IMS | 2.0 |
| 3 | 95 | 83 | IMS | 0.55 |
| 4 | 97 | 83 | IMS | 2.0 |
| 5 | 90 | 54 | IMS | 2.0 |

TABLE 1-continued

| Example number | syrup Brix | syrup temp | solvent | solvent:syrup ratio (ml/g) |
|---|---|---|---|---|
| 6 | 80 | 17 | IMS | 2.0 |
| 7 | 95 | 83 | IMS (azeotropic) | 0.55 |
| 8 | 95 | 83 | ethanol | 2.0 |

In all the instances of Examples 1 to 8, solid fructose was successively produced in yields between 50 and 80%. The product was a fine, white particulate material which after drying appeared to be microcrystalline. Individual crystals could just be resolved using a conventional microscope with 100× magnification. Example 3 gave the best yield but a higher solvent:syrup ratio made it easier to effect thorough dispersion. It was also noticeable that the higher Brix syrups of Examples 1 to 4, 7 and 8 were easier to use than the syrups of the other Examples. As a general trend, it was noticeable that with decrease in the syrup Brix the product tended to be more glassy and required more drying.

EXAMPLES 9 TO 14

The conditions were further investigated using the procedure of Examples 1 to 8. Pure fructose syrup was used in all Examples except example 11 (80% fructose and 20% glucose). The solvent was IMS with about 1 to 2% water except for Example 13, IMS with 6% water, and Example 14, where isopropyl alcohol (IPA) was used. For Example 12, the high shear mixer was replaced by a conventional motorized paddle stirrer operating at several hundred rpm.

The results are shown in Table 2.

TABLE 2

| Example number | syrup Brix | solvent | solvent:syrup ratio (ml/g) |
|---|---|---|---|
| 9 | 70 | IMS | 2.0 |
| 10 | 70 | IMS | 1.1 |
| 11 | 96 | IMS | 1.0 |
| 12 | 96 | IMS | 1.0 |
| 13 | 98 | IMS | 2.0 |
| 14 | 94 | IPA | 1.7 |

None of these further Examples gave rapid precipitation in accordance with the invention.

EXAMPLE 15

68.0 g of pure fructose 96 Brix syrup was added with shearing to 100 ml dry methanol containing 10 g of fructose seed. Rapid precipitation did not occur. Instead, crystallization proceeded slowly to give 20 g product (wet weight) after 20 minutes.

EXAMPLE 16

99 g of 96 Brix fructose syrup was added with shearing to 100 ml of a 50:50 volume mixture of isopropyl alcohol and methanol containing 5 g of seed. Rapid precipitation did occur. The mixture was left 5 minutes to cool and then filtered to give 43.7 g of undried product similar to that obtained in Examples 1 to 8.

EXAMPLES 17 AND 18

The procedure of Examples 1 to 8 was repeated but with addition of the alcohol to the syrup, rather than dispersion of the syrup in the alcohol. The operating conditions were as follows:

| Example number | fructose (%) | glucose (%) | Brix | solvent:syrup ratio (g/ml) |
|---|---|---|---|---|
| 17 | 95 | 5 | 95.4 | 2.04 |
| 18 | 100 | 0 | 92.0 | 1.8 |

In neither case was a precipitate obtained.

EXAMPLE 19

Following on from the Examples 1 to 8 and also taking in to account the results of the other Examples, a general preferred procedure was developed.

Fructose syrup was concentrated up to 95 to 97 Brix for the typical process. The syrup was cooled to around 70° to 75° C., the point when its viscosity is beginning to rapidly increase. The syrup was added to a similar amount of ethanol at room temperature, and the two mixed with a very high shear Silverson mixer.

Efficient dispersion of the syrup in the ethanolic medium was achieved by slowly adding the syrup with the mixer in operation, taking care to ensure that large globules of syrup did not form. If dispersion was found to be very difficult, the alcohol was preheated to 30° to 35° C., but care was taken to avoid the temperature of the dispersion rising above 50° C. during the mixing.

Efficient dispersion of the syrup was followed by an immediate precipitation of white fructose particles. The mixture was allowed to cool to ambient temperature over 5 to 10 minutes. Vacuum-assisted filtration using a sintered glass disc gave fast separation leaving a cake of fine fructose particles with up to 30% solvent. Filtration was followed by drying at around 40° C. Once most of the solvent had been removed, the oven temperature was safely increased up to 60° C. Using an oven with no agitation or vacuum, drying took up to 24 hours to reduce the solvent to an acceptable level.

Observation of the product under an electron microscope at nominal magnifications of 500 and 1000 revealed it to be crystalline in nature. The crystals were very small, around 10 to 20 micron long and less than that in width.

Figure 1:
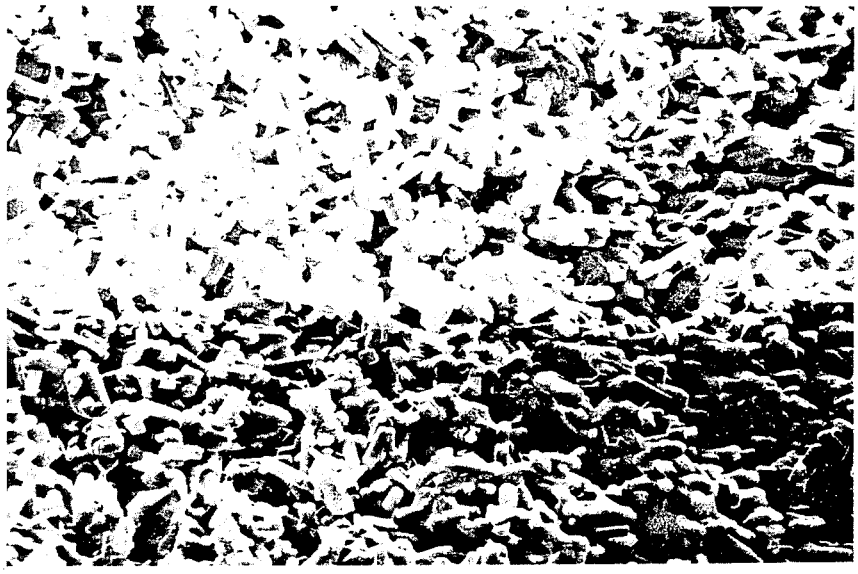
FIG. 1 is a micrograph at about 500 magnification of a typical product of this invention produced by the procedure of Example 19.
Figure 2:
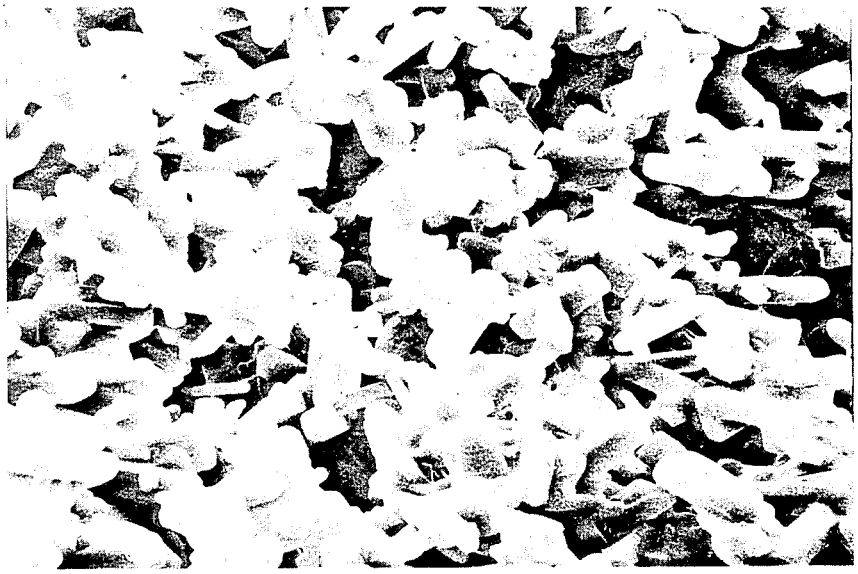
FIG. 2 is a micrograph at about 1000 magnification of the same product.

The nature of the product is apparent from the micrographs of FIGS. 1 and 2. It had an optical rotation of −132.3°, indicating the beta-D-pyranose form of fructose, and a heat of melting of 140 J/g, indicating 83% crystallinity.

In general, this preferred procedure can be operated in a variety of ways to give a good yield of product, with the fructose syrup containing more than 90% fructose solids at more than 90 Brix, and with the IMS containing up to 4 or 5% water, the solvent:syrup ratio being as low as 0.55.1 ml/g.

Figure 3:
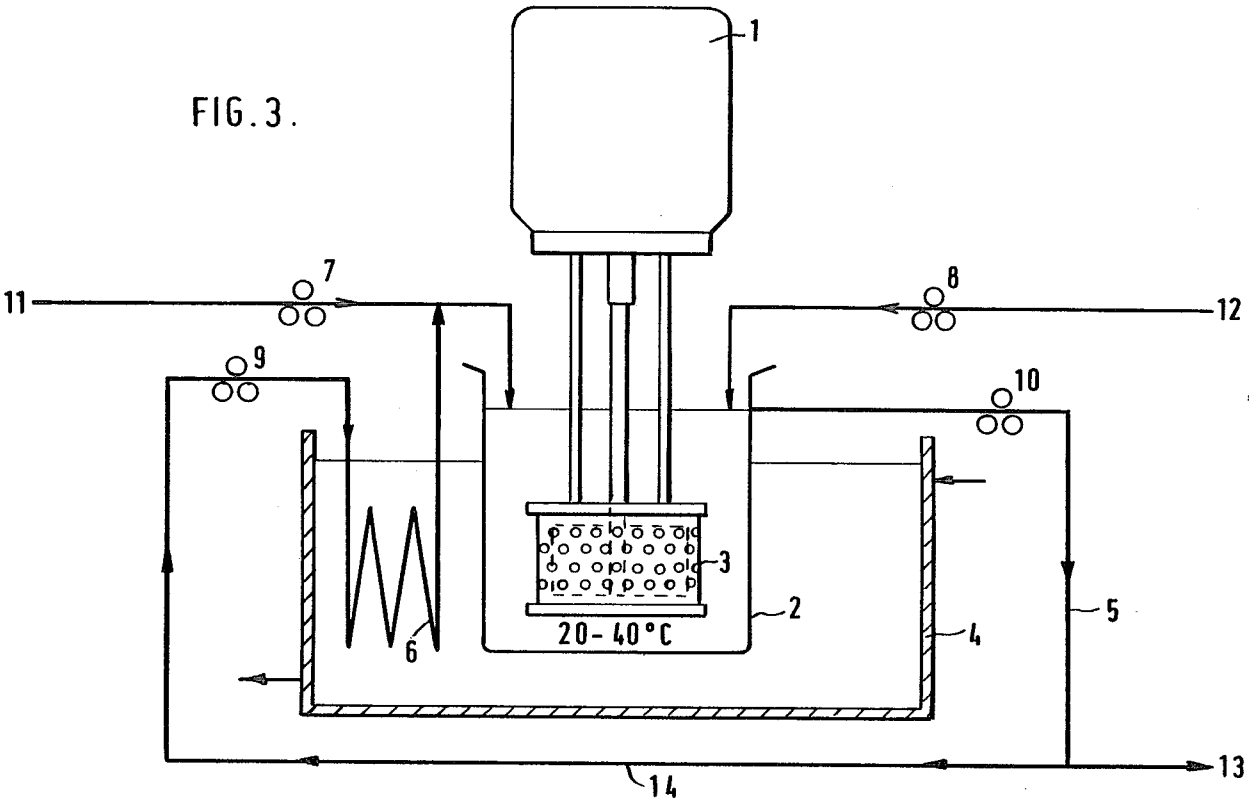
FIG. 3 is a diagrammatic representation of apparatus for carrying out a continuous precipitation process in accordance with the invention.

Equipment for a continuous process based on this procedure is shown in FIG. 3 of the accompanying drawings.

The equipment is based on a Silverson mixer 1 with a head 3 in a stainless steel mixing vessel 2 jacketed by a water bath 4 kept at 25° to 35° C. Ethanol at 15° to 25° C. from feed 11 is metered in from the left by pump 7, and syrup at 60° to 90° C. from feed 12 is metered in from the right by pump 8. Slurry is taken out at the top right of the vessel through line 5 by pump 10 and separated to give product along line 13 and a recycle stream (line 14) which is cooled using a cooling coil 6 of copper and cycled by pump 9 to join the IMS feed. At start-up the recycle is 100%, but the eventual recycle is usually 30 to 80%. In this instance, peristaltic pumps are employed to give accurate metering, and the lines are of silicone rubber tubing.

In one operating run, a priming slurry of crystalline fructose was prepared by dispersing with shear a fructose/glucose (95/5% w/w) syrup (96 Brix, 85° C., 208 g) in to IMS (160 g) with a separate very high shear mixer, and then transferred to the one liter vessel. Alternatively, priming can be omitted with direct feed of the streams.

The vessel was then fed with a fructose-glucose syrup (95/5% w/w) 1.710 kg at 85° and IMS 1.326 kg at 22° C. over 90 minutes. This represents a flow rate of 19.0 and 14.7 g/min for syrup and IMS respectively, corresponding to addition of 100 g syrup/100 ml IMS. The temperature of the vessel was kept at 45±3° C. by regulating the flow of cooling water through the water bath to remove the heat generated by the shearing device. The resulting slurry was removed from the vessel so that the vessel always contained a priming quantity of slurry. The residence time in the vessel was 11.1 minutes.

The slurry obtained from the vessel was then filtered to give the fructose product.

Equipment for carrying out the continuous process on an industrial scale is illustrated by the block diagram of FIG. 4. The processing steps are indicated by the labels to the various blocks, and further explanation is unnecessary.

EXAMPLE 20

140.4 g of 96.2 Brix syrup prepared from pure fructose was slowly added at 80° C. with very high shear mixing to 75 ml anhydrous (99%) IMS. The ratio of solvent to syrup was therefore 75/140.4 ml/g, i.e. about 0.5 ml/g. After standing for 20 minutes, the material was granulated and dried in a fluidised bed drier for 25 minutes at 50° C., 60 minutes at 60° C. and then cooled to 30° C. over 15 minutes, using occasional agitation. The product was a dry granular material.

The bulk density and dissolution rate (time to dissolve 10 g in 10 ml water) of the product were assessed in comparison with a representative fructose sample prepared by aqueous crystallization. The results are given as follows:

| | bulk density (g/ml) | dissolution rate (minutes) |
|---|---|---|
| conventional product | 0.71 | 5 |
| present product | 0.53 | 2 |

EXAMPLE 21

90.7 g of 98.0 Brix pure fructose syrup at 90° C. was slowly added with very high shear mixing to 50 ml anhydrous IMS. 72 g of this product was then transferred to a fresh 250 ml beaker and a further 50.6 g of syrup sheared in. The final ratio of solvent to syrup was therefore about 0.3 ml/g. The product solidified over a 2 hour period in an aluminum foil mould and was then dried as a block in a static oven at 35° C. and under vacuum for 2 hours. The product was then reduced to pass through a 2 mm sieve using a pestle and mortar and then further dried in a fluid bed drier for 50 minutes at 50° C. to give a granular product.

EXAMPLE 22

86.0 g of 96.0 Brix pure fructose syrup at 80° C. was slowly added with very high shear mixing to 35.0 g of 95% v/v IMS containing 4 g pure fructose seed. The mixture was held for ten minutes with cooling to remove the heat of shearing, and a further portion of 72.6 g syrup was sheared in. The final ratio of solvent to syrup was therefore about 0.2 g/g. The product was allowed to solidify in a foil mould, broken into pieces and dried in a static oven at 40° and vacuum, then reduced to pass through a 2 mm sieve and finally fluid bed dried for one hour at 50° C.

EXAMPLE 23

88.7 g of a 95.7 Brix mixed pure fructose (90%) and pure glucose (10%) syrup at 80° C. was slowly added using very high shear mixing to 39.5 g anhydrous IMS containing 4 g fructose seed which was a product of the invention and containing 5.3% glucose. The resulting slurry was cooled to about 40° C. in ice-water for 8 minutes to remove heat generated by the shearing and then a second portion of 32.4 g of syrup added with further shearing. The final ratio of solvent to syrup was therefore about 0.3 g/g. The product was held for 2 hours in an aluminium foil mould to solidify, broken into pieces with a knife and dried in a static oven at 35° and under vacuum. The product was then ground to pass through a 2 mm sieve and finally dried for 50 minutes at 50° in a fluid bed drier to give a granular product.

EXAMPLE 24

550 g of 70 Brix commercial fructose syrup (FRUCTAMYL L) was diluted with 550 g water, and 0.55 ml amyloglucosidase (Amyloglucosidase Novo 150) was added. The solution was stirred for 17 hours at 55° C. to effect saccharification, then held at 85° C. for 10 minutes to deactivate the enzyme and then concentrated back to 70 Brix. Deactivated enzyme was removed by filtration.

The treated syrup was then evaporated to 96.2 Brix at 95° C. on a Buchi rotary evaporator. The syrup was then held for 5 to 10 minutes to allow partial cooling and then slowly added in two portions with very high shear mixing to 33.3 g IMS containing 4 g seed which was a product of the invention. Cooling was applied with ice water to remove the heat of mixing. After gradual addition of a first portion of syrup (87.2 g), shearing was stopped for 10 minutes to allow cooling of the product, and then a second portion of (124.7 g, 211.9 g in total) was sheared in to give a pourable homogenous suspension. The product was then poured into a foil mould and allowed to solidify for two hours at room temperature. The resultant hard block was then broken into pieces and dried in a vacuum oven for one hour. The product (containing approximately 6% solvent) was then passed through a 2 mm sieve and further dried for one hour in a fluid bed drier to give granules of fructose in quantitative yield.

EXAMPLE 25

Fructamyl L, a commercially available fructose syrup was treated with amyloglucosidase as described in Example 24 and concentrated to 96.4 Brix. 108.4 g of the treated syrup at 80° C. was slowly added with shearing to 35.1 g of 95% v/v IMS containing 5 g of seed derived from Fructamyl L by the process of the invention, with a particle size less than 300 micron. The mixture was then cooled for ten minutes to remove the heat of shearing, and a further portion of syrup added (total 201.8 g). The final ratio of solvent to syrup was therefore about 0.2 g/g. The product was allowed to solidify for 2 hours in a foil mould, broken into pieces and dried for one hour in a static oven at 40° with vacuum. The material was reduced to pass through a 2 mm sieve and returned to the oven for one hour to give a granular product. The nature of the product is apparent from the micrograph of FIG. 5.

EXAMPLE 26

5.0 kg of amyloglucosidase-treated 35.0 Brix Fructamyl L at 45° C. was stirred with Norit Glucoblend activated carbon for 20 minutes to remove residual enzyme and trace impurities, filtered and concentrated to 64.0 Brix for storage.

The syrup was then concentrated to 96.0 Brix and 111.5 g syrup was slowly added to 35 ml IMS containing 4 g pure fructose seed with shearing, held for ten minutes with cooling and then a further 70.2 g syrup sheared in. The final ratio of solvent to syrup was therefore about 0.2 ml/g. The product was poured into a foil mould. After 20 minutes the mould was removed to give a solid block which after a further 25 minutes was sufficiently solid to be broken into small pieces which were transferred to a rotating Buchi flask under vacuum and the temperature raised from 36° to 46° over 40 minutes. The pieces were sieved to under 2 mm and returned to the flask and the temperature raised to 55° for a further 100 minutes. The granulated product contained 700 ppm ethanol and 0.84% water.

This procedure can be adapted for continuous operation using apparatus such as that shown in FIG. 6. The process consists of treating the feed syrup with amyloglucosidase and/or carbon, and then evaporating the syrup to the required concentration. The concentrated syrup then passes to the reaction vessels where it is sheared and dispersed in alcohol. The syrup is added continuously to the vessels 1, 2 and the blending tank. It is then allowed to solidify before being comminuted and dried.

EXAMPLE 27

Tablets were produced by direct compression using the following formulation (this and subsequent formulations are in parts by weight):

| | |
|---|---|
| fructose (Example 19) | 98 |
| gum arabic | 1 |
| magnesium stearate | 1 |

Tablets of consistent character were easily produced.

Tablets were also easily obtained using the formulation:

| | |
|---|---|
| fructose (Example 19) | 99 |
| magnesium stearate | 1 |

EXAMPLE 28

Tablets were produced by direct compression using the following formulation:

| | |
|---|---|
| fructose (Example 19) | 60 |
| ascorbic acid | 10 |
| magnesium stearate | 2 |
| tartrazine colour | qv |

-continued

| | |
|---|---|
| IFF orange 17.41.0023 flavour | qv |

Tablets of good shape and structure each weighing about 700 to 750 mg and containing about 100 mg ascorbic acid (vitamin.C) were readily formed.

EXAMPLE 29

A dry-mix beverage was prepared using a solidified fructose from Example 19 on the basis of the following formulation:

| ingredient | parts by weight |
|---|---|
| citric acid monohydrate | 27.1 |
| ascorbic acid | 0.6 |
| sodium citrate | 5.6 |
| orange flavour | 3.2 |
| colouring | 10.5 |
| solidified fructose | 52.8 |

The beverage for drinking was then prepared by adding water with stirring.

Two comparison pre-mixes were also prepared and used to prepare beverages. Firstly, fructose was crystallized in conventional manner from aqueous solution and used in place of the product of this invention. For the other comparison, the fructose was replaced by sucrose.

The pre-mix of this invention dissolved quicker than the comparison fructose pre-mix and had a better flavour than the sucrose pre-mix.

EXAMPLE 30

20 g totally solidified fructose from Example 20 was stirred in the mixing bowl of a food processor and mixture of vegetable oil ("Limmitts Spray-and-Fry"), permitted solvent, lecithin and antioxidant was sprayed in to a total of 1.72 g. The product was then stored for 2 days in an air-tight jar. Upon opening of the jar after storage, it was found that the product was still free-flowing.

In contrast, the use of solidified glucose gave a heavy, less suitable product.

We claim:

1. A process for producing solid fructose, said process comprising dispersing a fructose syrup of at least 80 Brix and at least 90% fructose on a dry solids basis in an alcoholic medium to give solid fructose, said dispersion being effected at high shear of 2,000 to 200,000 $s^{-1}$ and said alcoholic medium being one in which fructose is soluble to the extent of 1 to 10 wt% at the temperature at which said syrup is dispersed in said alcoholic medium, said temperature being from 20 to 55 degrees C. and the medium to syrup ratio being up to 3 ml/g.

2. The process of claim 1, wherein said high Brix fructose syrup is at least 90 Brix.

3. The process of claim 1, wherein said high Brix fructose syrup is prepared from a hydrolysed starch syrup by pre-treatment to removel alcohol-precipitable impurities and by evaporation.

4. The process of claim 1, wherein the dispersion temperature at which said syrup is dispersed in said alcoholic medium is between 40° and 50° C.

5. The process of claim 1, wherein the solids in said high Brix fructose syrup comprises around 95% fructose.

6. The process of claim 1, wherein said high shear is in the range 20,000 to 100,000 $s^{-1}$.

7. The process of claim 1, wherein the alcohol in said alcoholic medium is ethanol.

8. The process of claim 1, wherein said alcoholic medium is employed at 0.2 to 1.5 ml/g, in terms of medium volume per syrup weight.

9. The process of claim 8 wherein said high Brix fructose syrup is at lest 90 Brix, the dispersion temperature at which said syrup is dispersed in said alcoholic medium is between 40 and 50 degrees C., and wherein said high shear is 20,000 to 100,000 $s^{-1}$.

10. The process of claim 1 wherein said fructose syrup has a Brix of 80–98, the temperature at which said syrup is dispersed in said alcoholic medium is 23 to 47 degrees C., the alcoholic medium to syrup ratio is 0.2 to 2 ml/g and said alcoholic medium is selected from the group consisting of industrial methylated spirits, ethanol and a mixture of isopropyl alcohol and methanol.

11. The process of claim 8 wherein said fructose syrup is of 94–98 Brix and about 95% fructose.

12. The process of claim 1, which comprises precipitating fructose at a medium:syrup ratio of at least 0.5 ml/g.

13. The process of claim 1, which comprises solidifying fructose at a medium:syrup ratio of below 0.5 ml/g.

14. The process of claim 1, when carried out on a continuous basis.

15. A fructose product in the form of particles of agglomerated microcrystals of anhydrous fructose in which all said microcrystals have a maximum dimension of less than 50 microns and at least 95% of said microcrystals have a maximum dimension of 30 microns, said product having a bulk density of less than 0.65 g/ml.

16. The product of claim 15 wherein at least 95% of the microcrystals are rod shaped with a length of 10 to 30 microns and a width of 2 to 10 microns.

17. The product of claim 15 wherein at least 95% of the microcrystals have a maximum dimension of less than 20 microns.

18. The product of claim 15 having a bulk density ot 0.5 to 0.55 g/ml.

19. The product of claim 18 wherein at least 95% of the microcrystals are rod shaped with a length of 10 to 30 microns and a width of 2 to 10 microns.

* * * * *